US009205676B2

(12) United States Patent
DiRubio et al.

(10) Patent No.: US 9,205,676 B2
(45) Date of Patent: Dec. 8, 2015

(54) SYSTEM AND METHOD FOR IMAGE SURFACE PREPARATION IN AN AQUEOUS INKJET PRINTER

(71) Applicant: Xerox Corporation, Norwalk, CT (US)

(72) Inventors: Christopher A. DiRubio, Perrysburg, OH (US); Paul J. McConville, Webster, NY (US); Christopher G. Lynn, Wolcott, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/295,773

(22) Filed: Jun. 4, 2014

(65) Prior Publication Data

US 2014/0285564 A1 Sep. 25, 2014

Related U.S. Application Data

(62) Division of application No. 13/743,047, filed on Jan. 16, 2013, now Pat. No. 8,801,171.

(51) Int. Cl.

| | |
|---|---|
| ***B41J 11/00*** | (2006.01) |
| ***B41J 2/005*** | (2006.01) |
| ***B41J 2/01*** | (2006.01) |

(52) U.S. Cl.

CPC ..... *B41J 11/0015* (2013.01); *B41J 2/0057* (2013.01); *B41J 2/01* (2013.01); *B41J 2002/012* (2013.01)

(58) Field of Classification Search

None

See application file for complete search history.

(56) References Cited

U.S. PATENT DOCUMENTS

| | | | | |
|---|---|---|---|---|
| 5,365,261 | A | 11/1994 | Ozawa et al. | |
| 5,528,271 | A | 6/1996 | Ebisawa | |
| 5,778,298 | A | 7/1998 | Enomoto et al. | |
| 6,079,814 | A | 6/2000 | Lean et al. | |
| 6,491,364 | B2 | 12/2002 | Pietrzyk et al. | |
| 6,886,905 | B2 | 5/2005 | McElfresh et al. | |
| 6,997,538 | B1 | 2/2006 | Kawamura et al. | |
| 7,431,421 | B2 | 10/2008 | Carcia et al. | |
| 7,520,588 | B2 | 4/2009 | Domoto et al. | |
| 7,669,959 | B2 | 3/2010 | Sekimoto et al. | |
| 7,997,717 | B2 | 8/2011 | Taniuchi et al. | |
| 8,091,989 | B2 | 1/2012 | Desse | |
| 2004/0183879 | A1 * | 9/2004 | Nakazawa | 347/101 |
| 2007/0085879 | A1 | 4/2007 | May | |
| 2010/0295909 | A1 | 11/2010 | Doi et al. | |

* cited by examiner

*Primary Examiner* — Justin Seo

(74) *Attorney, Agent, or Firm* — Maginot, Moore & Beck LLP

(57) ABSTRACT

An aqueous inkjet printer is provided with a surface energy applicator that is positioned to treat the surface of a blanket immediately prior to a printhead ejecting ink onto the blanket. Modifying the surface energy of blanket with the electric field and charged particles produced by the applicator affects the adhesion of the ink to blanket. This adhesion changes from the impact of the ink on the blanket until the ink image is transferred to media. The surface energy applicator is operated during each print cycle to alter the surface energy of the blanket for each ink image formed on the blanket.

15 Claims, 4 Drawing Sheets

SYSTEM AND METHOD FOR IMAGE SURFACE PREPARATION IN AN AQUEOUS INKJET PRINTER

PRIORITY CLAIM

This application is a divisional patent application that claims priority to patent application Ser. No. 13/743,047, which is entitled "System And Method For Image Surface Preparation In An Aqueous Inkjet Printer," was filed on Jan. 16, 2013, and which issued as U.S. Pat. No. 8,801,171 on Aug. 12, 2014.

TECHNICAL FIELD

This disclosure relates generally to aqueous indirect inkjet printers, and, in particular, to surface preparation for aqueous ink inkjet printing.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the physical properties of the media. Because the spread of the ink droplets striking the media is a function of the media surface properties and porosity, the print quality will be inconsistent. To address this issue, indirect printers have been developed that eject ink onto a blanket mounted to a drum or endless belt. The ink is dried on the blanket and then transferred to media. Such a printer avoids the changes in image quality, drop spread, and media properties that occur in response to media contact with the water or solvents in aqueous ink. Indirect printers also reduce the effect of variations in other media properties that arise from the use of widely disparate types of paper and films used to hold the final ink images.

In aqueous ink indirect printing, an aqueous ink is jetted on to an intermediate imaging surface, typically called a blanket, and the ink is partially dried on the blanket prior to transfixing the image to a media substrate, such as a sheet of paper. To ensure excellent print quality the ink drops jetted onto the blanket must spread and not coalesce prior to drying. Otherwise, the ink images appear grainy and have deletions. The lack of spreading can also cause missing or failed inkjets in the printheads to produce streaks in the ink image. Spreading of aqueous ink is facilitated by materials having a high energy surface. In order to facilitate transfer of the ink image from the blanket to the media substrate, however, a blanket having a surface with a relatively low surface energy is preferred. These diametrically opposed and competing properties for a blanket surface make selections of materials for blankets difficult. Reducing ink drop surface tension helps, but the spread is still generally inadequate for appropriate image quality. Offline oxygen plasma treatments of blanket materials that increase the surface energy of the blanket have been tried and shown to be effective. The benefit of such offline treatment may be short lived due to surface contamination, wear, and aging over time.

Applying a coating material to the blanket can facilitate the wetting of the blanket surface with ink drops and the release of the ink image from the blanket surface. Coating materials have a variety of purposes that include wetting the blanket surface, inducing solids to precipitate out of the liquid ink, providing a solid matrix for the colorant in the ink, and/or aiding in the release of the printed image from the blanket surface. Reliably forming a coating layer on a blanket surface is a challenge. If the coating is too thin, it may fail to form a layer adequate to support an ink image. If the coating is too thick, a disproportionate amount of the coating may be transferred to media with the final image. Image defects arising from either phenomenon may significantly degrade final image quality. Consequently, development of blanket surfaces that provide high energy surfaces for image formation and then reduce the surface energy for image transfer without adding the issues of coating the blanket is desirable.

SUMMARY

An aqueous inkjet printer has been configured with a surface energy applicator to enable surface energy regulation of an imaging surface in the aqueous inkjet printer. The printer includes a printhead configured to eject aqueous ink and a rotating member having an intermediate imaging surface with a low surface energy, the rotating member is connected to electrical ground and is positioned to rotate the intermediate imaging surface in front of the printhead to enable the printhead to eject ink onto the intermediate imaging surface to form an aqueous ink image for a print cycle. A dryer is configured to at least partially dry the aqueous ink image ejected onto the intermediate imaging surface, and a transfer roller is configured to form a nip with the intermediate imaging surface to enable the at least partially dried aqueous ink image on the intermediate imaging surface to transfer to media as the media passes through the nip. A surface energy applicator is configured to generate an electric field to produce and direct energized particles towards the intermediate imaging surface. The surface energy applicator is positioned to direct the energized particles towards the intermediate imaging surface after the aqueous ink has been transferred to the media and before the printhead ejects aqueous ink onto the intermediate imaging surface treated with the energized particles.

DETAILED DESCRIPTION

Figure 1:
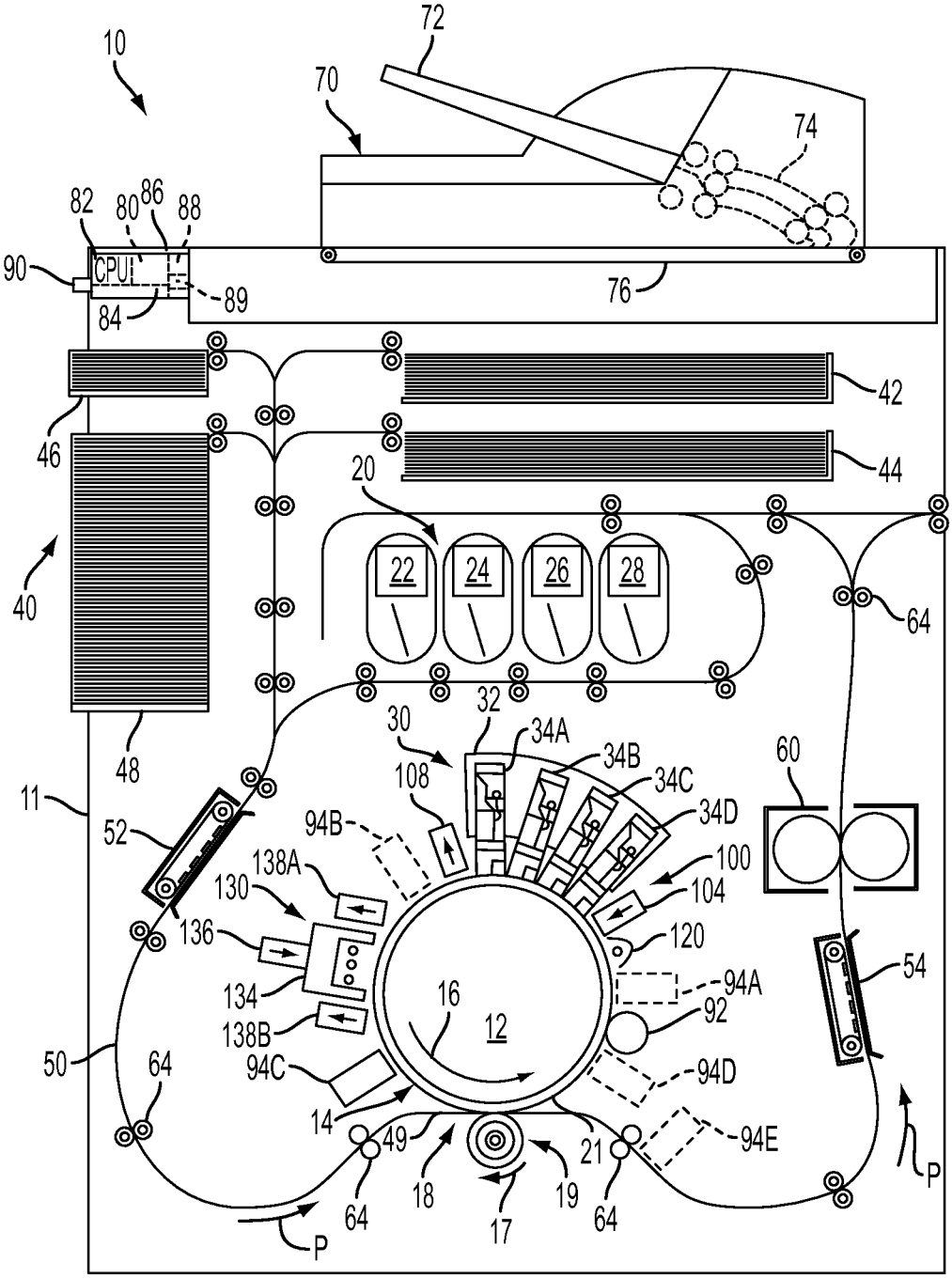
FIG. 1 is a schematic drawing of an aqueous indirect inkjet printer that prints sheet media.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water relative to the amount of colorant and/or solvent in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction across the image receiving surface. As used in this document, the term "aqueous ink" includes liquid inks in which colorant is in solution with water and/or one or more solvents.

FIG. 1 illustrates a high-speed aqueous ink image producing machine or printer 10. As illustrated, the printer 10 is an indirect printer that forms an ink image on a surface of a blanket 21 mounted about an intermediate rotating member 12 and then transfers the ink image to media passing through a nip 18 formed between the blanket 21 and the transfix roller 19. A print cycle is now described with reference to the printer 10. As used in this document, "print cycle" refers to the operations of a printer to prepare an imaging surface for printing, ejection of the ink onto the prepared surface, treatment of the ink on the imaging surface to stabilize and prepare the image for transfer to media, and transfer of the image from the imaging surface to the media.

The printer 10 includes a frame 11 that supports directly or indirectly operating subsystems and components, which are described below. The printer 10 includes an image rotating member 12 that is shown in the form of a drum, but can also be configured as a supported endless belt. The image rotating member 12 has an outer blanket 21 mounted about the circumference of the member 12. The blanket moves in a direction 16 as the member 12 rotates. A transfix roller 19 rotatable in the direction 17 is loaded against the surface of blanket 21 to form a transfix nip 18, within which ink images formed on the surface of blanket 21 are transfixed onto a media sheet 49.

The blanket is formed of a material having a relatively low surface energy to facilitate transfer of the ink image from the surface of the blanket 21 to the media sheet 49 in the nip 18. Such materials include silicones, fluoro-silicones, Viton, and the like. A surface maintenance unit (SMU) 92 removes residual ink left on the surface of the blanket 21 after the ink images are transferred to the media sheet 49. The low energy surface of the blanket does not aid in the formation of good quality ink images because such surfaces do not spread ink drops as well as high energy surfaces. Consequently, some embodiments of SMU 92 also apply a coating to the blanket surface. The coating helps aid in wetting the surface of the blanket, inducing solids to precipitate out of the liquid ink, providing a solid matrix for the colorant in the ink, and aiding in the release of the ink image from the blanket. Such coatings include surfactants, starches, and the like. In other embodiments, a surface energy applicator 120, which is described in more detail below, operates to treat the surface of blanket for improved formation of ink images without requiring application of a coating by the SMU 92.

The SMU 92 can include a coating applicator having a reservoir with a fixed volume of coating material and a resilient donor roller, which can be smooth or porous and is rotatably mounted in the reservoir for contact with the coating material. The donor roller can be an elastomeric roller made of a material, such as silicone or grafted Viton, or be an anilox roller. The coating material is applied to the surface of the blanket 21 to form a thin layer on the blanket surface. The SMU 92 is operatively connected to a controller 80, described in more detail below, to enable the controller to operate the donor roller, metering blade and cleaning blade selectively to deposit and distribute the coating material onto the surface of the blanket and remove untransferred ink pixels from the surface of the blanket 21.

The printer 10 includes an optical sensor 94A, also known as an image-on-drum ("IOD") sensor, which is configured to detect light reflected from the blanket surface 14 and the coating applied to the blanket surface as the member 12 rotates past the sensor. The optical sensor 94A includes a linear array of individual optical detectors that are arranged in the cross-process direction across the blanket 21. The optical sensor 94A generates digital image data corresponding to light that is reflected from the blanket surface 14 and the coating. The optical sensor 94A generates a series of rows of image data, which are referred to as "scanlines," as the image receiving member 12 rotates the blanket 21 in the direction 16 past the optical sensor 94A. In one embodiment, each optical detector in the optical sensor 94A further comprises three sensing elements that are sensitive to wavelengths of light corresponding to red, green, and blue (RGB) reflected light colors. Alternatively, the optical sensor 94A includes illumination sources that shine red, green, and blue light or, in another embodiment, the sensor 94A has an illumination source that shines white light onto the surface of blanket 21 and white light detectors are used. The optical sensor 94A shines complementary colors of light onto the image receiving surface to enable detection of different ink colors using the photodetectors. The image data generated by the optical sensor 94A is analyzed by the controller 80 or other processor in the printer 10 to identify the thickness of the coating on the blanket and the area coverage. The thickness and coverage can be identified from either specular or diffuse light reflection from the blanket surface and/or coating. Other optical sensors, such as 94B, 94C, and 94D, are similarly configured and can be located in different locations around the blanket 21 to identify and evaluate other parameters in the printing process, such as missing or inoperative inkjets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 also includes a surface energy applicator 120 positioned next to the blanket surface at a position immediately prior to the surface of the blanket 21 entering the print zone formed by printhead modules 34A-34D. The construction and operation of the surface energy applicator 120 is described in more detail below. The applicator 120 can be, for example, a corotron, a scorotron, or biased charge roller. The coronode of a scorotron or corotron used in the applicator 120 can either be a conductor in an applicator operated with AC or DC electrical power or a dielectric coated conductor in an applicator supplied with only AC electrical power. The devices with dielectric coated coronodes are sometimes referred to as dicorotrons or discorotrions.

The surface energy applicator 120 is configured to emit an electric field between the applicator 120 and the surface of the blanket 21 that is sufficient to ionize the air between the two structures and apply negatively charged particles, positively charged particles, or a combination of positively and negatively charged particles to the blanket surface and/or the coating. The electric field and charged particles increase the surface energy of the blanket surface and/or coating. Additionally, the kinetic energy of the charged particles can dislodge surface atoms and break chemical bonds to increase surface energy. The increased surface energy of the surface of the blanket 21 enables the ink drops subsequently ejected by the printheads in the modules 34A-34D to be spread adequately to the blanket surface 21 and not coalesce.

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow can be through the print zone as a whole or about one or more printhead arrays. The regulation of the air flow helps prevent evaporated solvents and water in the ink from condensing on the printhead and helps attenuate heat in the print zone to reduce the likelihood that ink dries in the inkjets, which can clog the inkjets. The airflow management system 100 can also include sensors to detect humidity and temperature in the print zone to enable more precise control of the temperature, flow, and humidity of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous ink printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 1, the printhead system 30 includes a printhead support 32, which provides support for a plurality of printhead modules, also known as print box units, 34A through 34D. Each printhead module 34A-34D effectively extends across the width of the blanket and ejects ink drops onto the surface 14 of the blanket 21. A printhead module can include a single printhead or a plurality of printheads configured in a staggered arrangement. Each printhead module is operatively connected to a frame (not shown) and aligned to eject the ink drops to form an ink image on the coating on the blanket surface 14. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the blanket surface 14 exits the print zone, the image passes under an image dryer 130. The image dryer 130 includes a heater, such as a radiant infrared, radiant near infrared and/or a forced hot air convection heater 134, a heated air source 136, and air returns 138A and 138B. The infrared heater 134 applies infrared heat to the printed image on the surface 14 of the blanket 21 to evaporate water or solvent in the ink. The heated air source 136 directs heated air over the ink to supplement the evaporation of the water or solvent from the ink. The air is then collected and evacuated by air returns 138A and 138B to reduce the interference of the air flow with other components in the printing area.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The printer 10 includes an optional fusing device 60 to apply additional heat and pressure to the print medium after the print medium passes through the transfix nip 18. In the embodiment of FIG. 1, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines and/or accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the blanket surface 14 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the blanket and coating 21 to the media substrate within the transfix nip 18.

Figure 2:
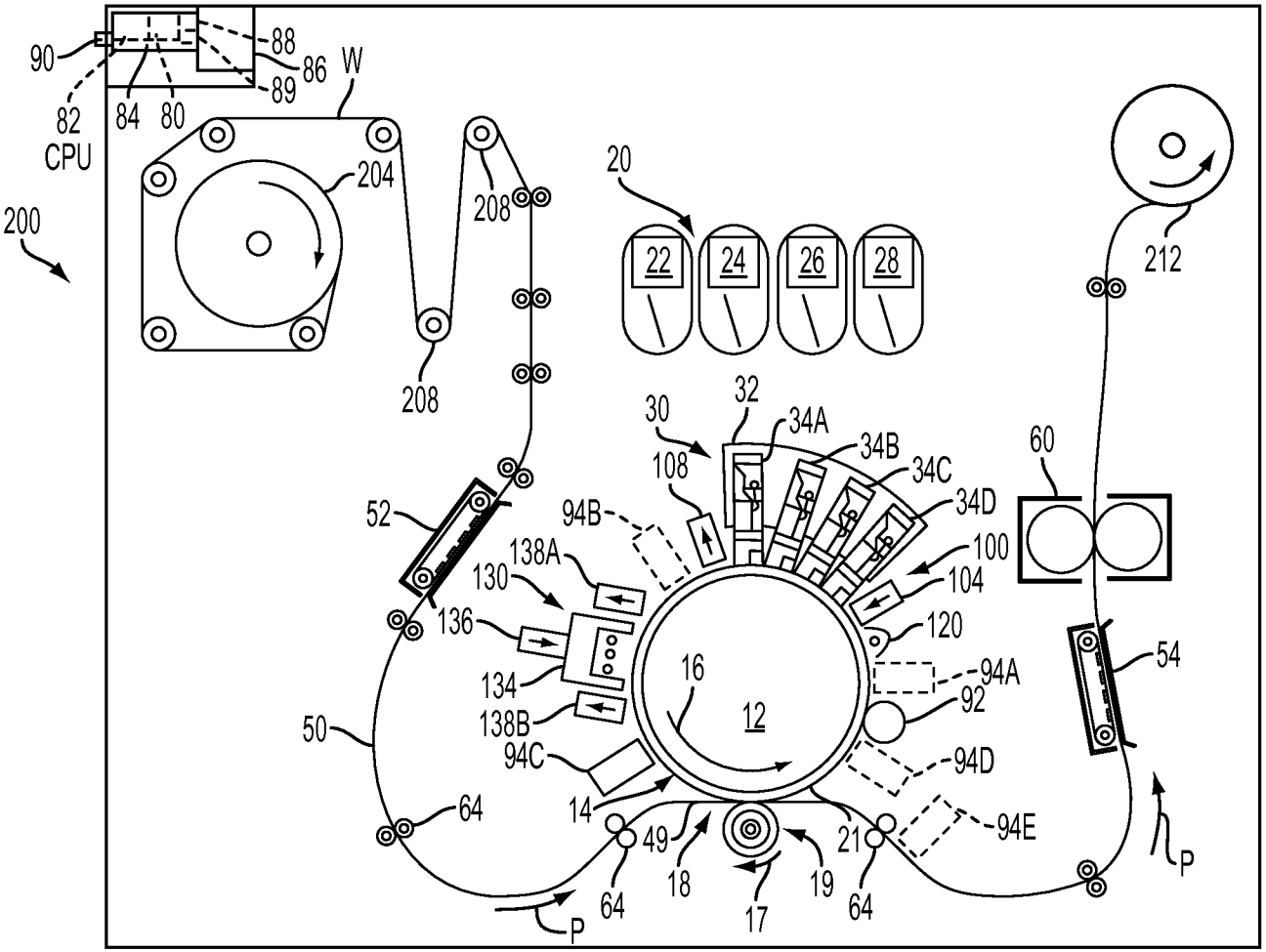
FIG. 2 is a schematic drawing of an aqueous indirect inkjet printer that prints a continuous web.

Although the printer 10 in FIG. 1 and the printer 200 in FIG. 2 are described as having a blanket 21 mounted about an intermediate rotating member 12, other configurations of an image receiving surface can be used. For example, the intermediate rotating member can have a surface integrated into its circumference that enables an aqueous ink image to be formed on the surface. Alternatively, a blanket could be configured as an endless belt and rotated as the member 12 is in FIG. 1 and FIG. 2 for formation of an aqueous image. Other variations of these structures can be configured for this purpose. As used in this document, the term "intermediate imaging surface" includes these various configurations.

In some printing operations, a single ink image can cover the entire surface 14 of the blanket 21 (single pitch) or a plurality of ink images can be deposited on the blanket 21 (multi-pitch). In a multi-pitch printing architecture, the surface of the image receiving member can be partitioned into multiple segments, each segment including a full page image in a document zone (i.e., a single pitch) and inter-document zones that separate multiple pitches formed on the blanket 21. For example, a two pitch image receiving member includes two document zones that are separated by two inter-document zones around the circumference of the blanket 21. Likewise, for example, a four pitch image receiving member includes four document zones, each corresponding to an ink image formed on a single media sheet, during a pass or revolution of the blanket 21.

Once an image or images have been formed on the blanket and coating under control of the controller 80, the illustrated inkjet printer 10 operates components within the printer to perform a process for transferring and fixing the image or images from the blanket surface 14 to media. In the printer 10, the controller 80 operates actuators to drive one or more of the rollers 64 in the media transport system 50 to move the media sheet 49 in the process direction P to a position adjacent the transfix roller 19 and then through the transfix nip 18 between the transfix roller 19 and the blanket 21. The transfix roller 19 applies pressure against the back side of the recording media 49 in order to press the front side of the recording media 49 against the blanket 21 and the image receiving member 12. Although the transfix roller 19 can also be heated, in the exemplary embodiment of FIG. 1, the transfix roller 19 is unheated. Instead, the pre-heater assembly 52 for the media sheet 49 is provided in the media path leading to the nip. The pre-conditioner assembly 52 conditions the media sheet 49 to a predetermined temperature that aids in the transferring of the image to the media, thus simplifying the design of the transfix roller. The pressure produced by the transfix roller 19 on the back side of the heated media sheet 49 facilitates the transfixing (transfer and fusing) of the image from the image receiving member 12 onto the media sheet 49. The rotation or rolling of both the image receiving member 12 and transfix roller 19 not only transfixes the images onto the media sheet 49, but also assists in transporting the media sheet 49 through the nip. The image receiving member 12 continues to rotate to enable the printing process to be repeated.

In the embodiment shown in FIG. 2, like components are identified with like reference numbers used in the description of the printer in FIG. 1. One difference between the printers of FIG. 1 and FIG. 2 is the type of media used. In the embodiment of FIG. 2, a media web W is unwound from a roll of media 204 as needed and a variety of motors, not shown, rotate one or more rollers 208 to propel the media web W through the nip 18 so the media web W can be wound onto a roller 212 for removal from the printer. Alternatively, the media can be directed to other processing stations that perform tasks such as cutting, binding, collating, and/or stapling the media or the like. One other difference between the printers 10 and 200 is the nip 18. In the printer 200, the transfer roller continually remains pressed against the blanket 21 as the media web W is continuously present in the nip. In the printer 10, the transfer roller is configured for selective movement towards and away from the blanket 21 to enable selective formation of the nip 18. Nip 18 is formed in the embodiment of FIG. 1 in synchronization with the arrival of media at the nip to receive an ink image and is separated from the blanket to remove the nip as the trailing edge of the media leaves the nip.

Figure 3:
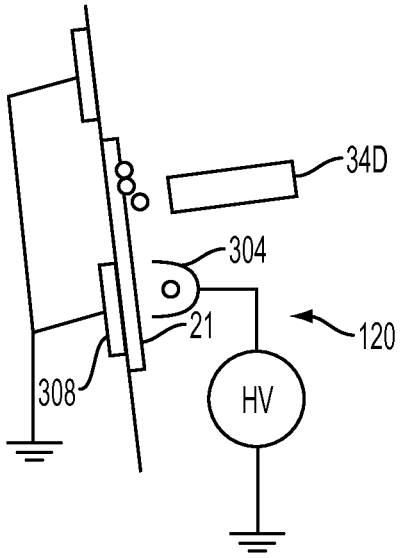
FIG. 3 is a schematic drawing of a surface energy applicator and its configuration in an aqueous inkjet printer.
Figure 4A:
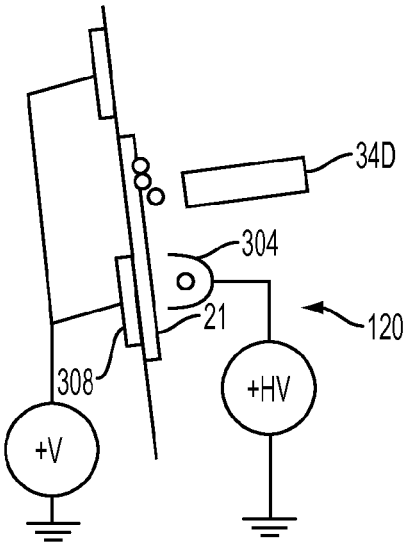
FIGS. 4A, 4B, 4C, and 4D depict alternative embodiments of the surface energy applicator shown in FIG. 3.
Figure 4B:
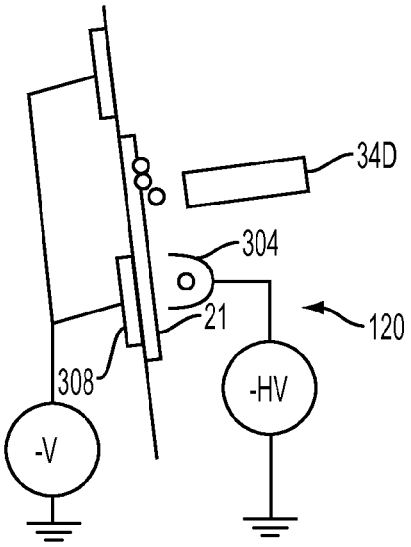
Figure 4C:
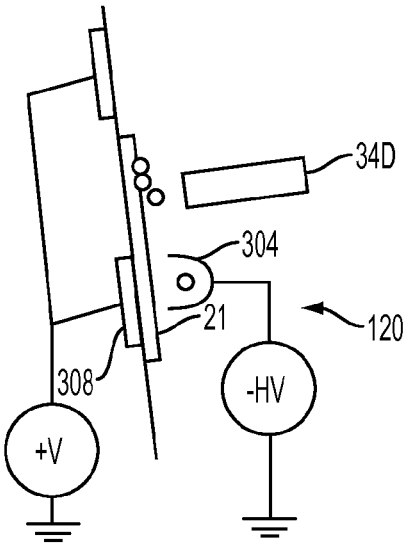
Figure 4D:
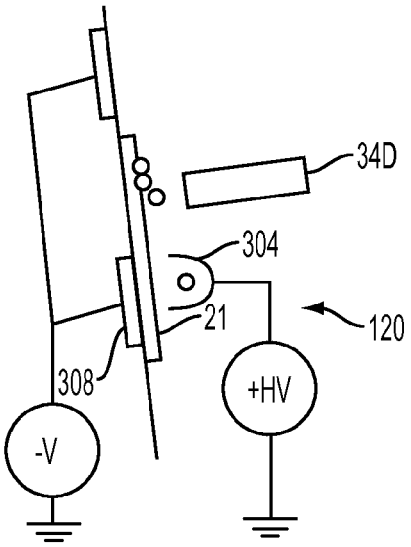

The surface energy applicator 120 is shown in more detail in FIG. 3. The surface energy applicator 120 includes a charging device 304, which is positioned to face the surface of the blanket 21 onto which aqueous ink is ejected, and an electrical grounding electrode 308 that is connected to electrical ground on the opposite side of the blanket 21. In the embodiment shown in FIG. 3, the surface energy applicator is at one electrical potential, either negative or positive with regard to electrical ground, and the rotating member is connected to electrical ground to ensure the surface of the rotating member and/or blanket is at a different electrical potential. In other embodiments, such as the ones shown in FIGS. 4A, 4B, 4C, and 4D, the rotating member and the surface energy applicator can be at different electrical potentials of the same or different polarities. In one embodiment, the charging device generates an electric field that extends from the charging device towards the surface of the blanket 21 that is high enough to cause air breakdown. "Air breakdown" refers to the electrical energy removing electrons from molecules in the air. The removal of the electrons produces both negatively charged electrons and positively charged ions of various reactive species. For example, oxygen, nitrogen, or nitrous oxide molecules in the air energized by the electric field have electrons knocked from them to produce positively charged ions. Electrons may also attach to neutral atoms to generate negatively charged ions. The electric field also generates an electromotive force that directs some of the ions and/or electrons towards the surface of the blanket. The region of air that is ionized by the electric filed is called a corona.

The deposition of the ions and/or electrons has been observed to increase the ink drop spread. This increase in ink drop spread is thought to arise from a variety of mechanisms. Some of these mechanisms are increased surface energy of the blanket arising from the deposition of positively charged ions only, negatively charged ions only, a combination of positively and negatively charged ions, and/or the deposition of negatively charged electrons. Other mechanisms thought to contribute to the increased ink drop spread are the breaking of chemical bonds from chemical interactions between some of the deposited ions and the material forming the blanket or the bonds are broken by the high kinetic energy of the ions striking the molecules of the blanket material.

The charging device 304 can be either a large gap charging device or a small gap charging device. As used in this document, "large gap charging devices" means the emitters of the charging device are separated from the blanket surface by 0.5 to 5 mm. As used in this document, "small gap charging devices" means the emitters of the charging device either contact the blanket surface or are separated from the blanket surface by no more than about 50 μm. Thus, in large gap charging devices, the corona is typically localized in the region of the device and does not contact the surface. Examples of large gap charging devices include corotrons and scorotrons that may have coronodes (electrodes that generate corona) made of conductive pins, wires, or dielectric coated wires. Large gap charging devices are thought to deposit charge at kinetic energies too weak to break bonds in the blanket surface. Small gap charging devices include contact and/or non-contact biased charger rollers. These devices generate a corona that "contacts" both the surface of the charging device and the surface of the blanket. These types of devices generate very high magnitude fields in the air gap that produce high kinetic energy ions that increase the probability of bond breaking and surface damage on the blanket surface. The charging device 304 can also be a triboelectric device that charges the blanket surface through contact with the surface. Such a triboelectric device does not generate a corona to charge the surface. Instead, the triboelectric device is made of a material that is dissimilar from the blank surface and generates electrostatic charge on the blanket surface in response to the blanket surface being in moving contact with the triboelectric device.

The high voltage bias of the charging device 304 can be operated in at least five modes. The five modes are (1) positive bias voltage, (2) negative bias voltage, (3) AC voltage only, (4) AC voltage with a positive DC bias, and (5) AC voltage with a negative DC bias. The first mode produces a net positive charge on the blanket surface from the deposition of positive ions on the blanket surface. The second mode produces a net negative charge on the blanket surface from the deposition of negative ions and electrons on the blanket surface. The fourth mode produces a net positive charge on the blanket surface from the deposition of positive and negative ions and electrons on the blanket surface. The fifth mode produces a net negative charge on the blanket surface from the deposition of positive and negative ions and electrons on the blanket surface.

In the mode that uses an AC voltage only, the net charge on the blanket surface is zero, but the charging device deposits an equal amount of positively and negatively charged species on the blanket surface. This result is advantageous because the presence of charge on the blanket surface can affect the drops as they are ejected from a printhead. Specifically, charge on the blanket surface can cause the tail of an ink drop to separate from the ink drop body and return to the printhead face. These separated tails are known as satellites in the art. The presence of satellites on a printhead face can clog or otherwise interfere with the operation of the printhead. In order to operate the charging device in the AC voltage mode only, the charging device is typically operated with a symmetrical AC voltage. Even though the blanket surface is charged, the electric field may be too small to impact satellite formation and printhead contamination of the printhead surface. The electric field in the gap is a strong function of the surface charge density, the thickness of the blanket, the electrical properties of the blanket (resistivity and dielectric constant), and the size of the air gap between the blanket and the head. The electric field is small if the blanket is conductive and/or if the dielectric thickness (thickness/dielectric constant) is small compared to the size of the air gap.

While the surface energy applicator 120 increases the surface energy of the blanket, the ejection of ink drops on the blanket and the subsequent drying of the ink image and its transfer to the media deplete some of that energy. Consequently, the surface energy applicator 120 is operated each print cycle to increase the surface energy of the blanket before the blanket returns to the position opposite the printhead for printing. Because the increase in surface is at least partially dissipated by the time the ink image reaches the nip 18, the transfer of the ink image is facilitated by the lower surface energy of the blanket. Thus, the use of the surface energy applicator 120 at the position immediately prior to the printhead enables the blanket surface to be at a relatively high level for ink ejection and adhesion and then be dissipated to aid in the transfer of the ink image. In other words, the adhesion of the ink to the surface determines the efficiency of the transfer of the ink to the media. How much the surface energy impacts the ink adhesion is a function of the state (e.g. liquid, solid, gas) of the material contacting the surface. Consequently, the surface energy treatment described above may strongly increase the adhesion of the low viscosity liquid at the ejection of the ink, but the impact of the surface treatment on the adhesion of the partially dried ink at transfer of the ink may lessen. In other words, the adhesion of the ink may involve an interaction between the surface energy modification of the blanket and the state of the ink (liquid vs semi-solid or "wet" solid).

One or more of the optical sensors 94A to 94D can be used to generate image data of the intermediate imaging surface and the ejected ink on the surface. The sensor used to generate the image data can be located before or after the drying station to enable closed loop control of the bias on the charging device. This closed loop control can be achieved with reference to processing of the image data by a controller to measure the spread of the ink drops. The drop spread diameter is then compared to a predetermined threshold for ink drop spread. The bias of the charging device is adjusted in response to the spread diameter falling below a predetermined threshold. In some embodiments, the spread diameter is compared to an upper threshold and a lower threshold and, in response to the spread diameter being outside the range between the upper threshold and the lower threshold, the charging device is adjusted. This process can be repeated until the drop diameter (drop spread) hits the target level of spread.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a printhead configured to eject aqueous ink;

a rotating member having an intermediate imaging surface with a low surface energy, the rotating member being positioned to rotate the intermediate imaging surface in front of the printhead to enable the printhead to eject aqueous ink onto the intermediate imaging surface to form an aqueous ink image for a print cycle, and the rotating member being connected to a first electrical potential;

a dryer configured to at least partially dry the aqueous ink image ejected onto the intermediate imaging surface;

a transfer roller configured to form a nip with the intermediate imaging surface to enable the at least partially dried aqueous ink image on the intermediate imaging surface to transfer to media as the media passes through the nip; and a surface energy applicator configured to generate an electric field to produce and direct energized particles towards the intermediate imaging surface, the surface energy applicator being positioned to direct the energized particles towards the intermediate imaging surface after the aqueous ink has been transferred to the media and before the printhead ejects aqueous ink onto the intermediate imaging surface treated with the energized particles, and the surface energy applicator being connected to a second electrical potential that is different than the first electrical potential and the first and the second electrical potentials have a same polarity.

2. The printer of claim 1, the surface energy applicator further comprising:

a small gap corona generating device.

3. The printer of claim 2 wherein the small gap corona generating device is a biased charger roller.

4. The printer of claim 1, the surface energy applicator further comprising:

a large gap corona generating device.

5. The printer of claim 4 wherein the large gap corona generating device is a corotron.

6. The printer of claim 4 wherein the large gap corona generating device is a scorotron.

7. The printer of claim 1, the surface energy applicator being further configured to be operated with a positive high voltage.

8. The printer of claim 1, the surface energy applicator being further configured to be operated with a negative high voltage.

9. The printer of claim 1, the surface energy applicator being further configured to be operated with an AC voltage source only.

10. The printer of claim 9, the AC voltage source being further configured to generate the electric field with a symmetrical AC voltage.

11. The printer of claim 1, the surface energy applicator being further configured to be operated with an AC voltage source having a positive DC bias.

12. The printer of claim 1, the surface energy applicator being further configured to be operated with an AC voltage source having a negative DC bias.

13. The printer of claim 1, the surface energy applicator being further configured to generate the electric field and direct charged particles towards the intermediate imaging surface for each print cycle performed with the printhead, dryer, and transfer roller.

14. The printer of claim 1 further comprising:

an optical sensor positioned to generate image data of the intermediate imaging surface; and a controller operatively connected to the optical sensor and the surface energy applicator, the controller being configured to process the image data generated by the optical sensor to measure an ink drop spread for ink drops on the intermediate imaging surface and to adjust electrical power provided to the surface energy applicator in response to the measured ink drop spread being less than a predetermined threshold.

15. The printer of claim 14 wherein the controller is further configured to adjust electrical power provided to the surface energy applicator in response to the measured ink drop spread being greater than another predetermined threshold.

* * * * *